United States Patent [19]

Davis et al.

[11] Patent Number: 4,568,355

[45] Date of Patent: Feb. 4, 1986

[54] CLEAR STABLE GASOLINE COMPOSITION

[75] Inventors: Marshall E. Davis, Poughkeepsie; Rodney L. Sung, Fishkill, both of N.Y.

[73] Assignee: Texaco Inc., White Plains, N.Y.

[21] Appl. No.: 740,161

[22] Filed: Jun. 3, 1985

[51] Int. Cl.[4] ..... C10L 1/32

[52] U.S. Cl. ..... 44/51; 44/53; 44/78; 252/351

[58] Field of Search ..... 44/51, 53, 78; 252/351

[56] References Cited

U.S. PATENT DOCUMENTS

| | | | |
|---|---|---|---|
| 3,488,733 | 1/1970 | Diassi et al. | 252/356 |
| 3,557,087 | 1/1971 | Levine | 252/351 |
| 4,218,334 | 8/1980 | Lundmark | 252/356 |

*Primary Examiner*—Y. Harris-Smith

*Attorney, Agent, or Firm*—Robert A. Kulason; James J. O'Loughlin; Vincent A. Mallare

[57] ABSTRACT

A process for converting a hazy, water-saturated alcohol-gasoline blend into a clear, stable gasoline composition having an improved octane rating. The conversion is made by adding to and blending with the hazy, water-saturated gasoline, a nonionic surfactant of an adduct of soya sterol and a polyalkylene oxide.

22 Claims, No Drawings

CLEAR STABLE GASOLINE COMPOSITION

BACKGROUND OF THE INVENTION

1. Field of the Invention

This invention relates to fuels for internal combustion engines and more particularly to a novel process whereby a hazy alcohol-gasoline composition can be converted to a clear stable blend down to −10° F.

The use of aliphatic alcohols such as methanol and ethanol to extend gasoline fuels while imparting a higher octane rating to the gasoline has been desired for some time. However, alcohol-gasoline blends have a low tolerance for water that is encountered in the blending and distribution systems. Methane-gasoline blends are much less water tolerant than ethanol-gasoline blends. Unstable haze blends may result when water is present in such systems and/or when there is a sudden drop in ambient temperature. Hazy gasolines are unacceptable by the public since they may indicate that the fuel may be contaminated or perform unsatisfactorily. Further, phase separation may occur with water and alcohol separating out and contributing to corrosion problems and motor starting difficulties.

Although some water in the gasoline is desirable since the presence of water will reduce the Octane Requirement Increase (ORI), and will increase the Octane Rating (OR), a hazy blend will result when a commercial alcohol-gasoline blend, e.g., Oxinol 30*-gasoline, is contaminated with water, i.e., the alcohol-gasoline is saturated with water.

*Combination alcohol product mfgd. by Arco Chemical Co.

An alcohol-gasoline blend may become hazy when any moisture comes in contact with it when the alcohol-gasoline is in storage tanks or is being transported in any system, e.g., trucking, etc., or when it comes in conact with other gasoline blends, e.g., unleaded gasolines, other grades of gasolines, etc., or when the ambient temperature suddenly drops below about 35° F.

Thus, an object of the present invention is to provide a process for converting a hazy water-saturated alcohol-gasoline into a clear stable gasoline blend down to sub-zero temperatures, i.e. less than 0° F., and improve the Octane Rating (OR) of the gasoline.

2. Disclosure Statement

U.S. Pat. No. 3,876,391 discloses motor fuel microemulsions comprising gasoline, water, two different surfactants and a water soluble and insufficiently gasoline soluble additive. The gasoline does not contain any alcohol.

U.S. Pat. No. 4,384,872 discloses a motor fuel composition comprising gasoline, alcohol, and an interfacial modifying agent. The gasoline does not contain any water.

U.S. Pat. Nos. 3,822,119, 3,876,391, 4,002,435, and 4,445,908 disclose the addition of an excessive amount of surfactants and alcohol to manufacture a clear emulsion of methanol-water-gasoline, or an excessive amount of alcohol to solubilize water into gasoline whereby a lean fuel/air ratio is obtained resulting in an engine's difficult cold start and poor drivability.

U.S. Pat. No. 4,398,920 discloses the addition of an excessive amount of butanol-acetone as a cosolvent for methanol, acetone, and isopropanol and gasoline where severe corrosion and wear will occur in the internal combustion engine besides having a difficult cold start and lack of drivability.

SUMMARY OF THE INVENTION

A process for making a clear, stable gasoline from a hazy, water-saturated gasoline containing a mixture of hydrocarbons in the gasoline boiling range, from about 2.0 to about 12.0 of methanol, from about 2.0 from about 10.0 of a cosolvent ($C_2$–$C_5$) aliphatic alcohol, and from about 0.1 to about 0.5 volume percent of contaminating water, said process comprising adding to the water-saturated gasoline from about 0.05 to about 1.8 weight percent of a nonionic surfactant of an adduct of soya sterol and a polyalkylene oxide

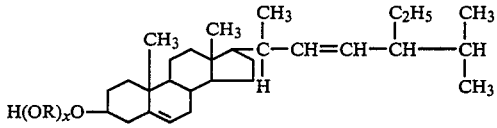

(I)

wherein x is a numeral of about 5 to about 30, and R is a ($C_1$–$C_5$) alkylene group.

DISCLOSURE OF THE INVENTION

The present invention provides a process for rendering a hazy, water-saturated gasoline blend clear and stable. The water-saturated, i.e., water contaminated, alcohol-gasoline blend may become hazy when the ambient temperature decreases below about 35° F. This hazy gasoline can be rendered clear and stable down to a temperature of about −10° F. by adding to such water-saturated gasoline, a nonionic surfactant of an adduct of soya sterol and a polyalkylene oxide

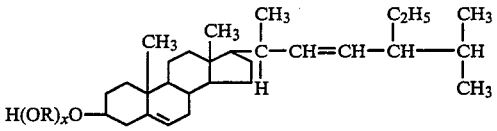

(I)

wherein x is a numeral of about 5 to about 30, preferably about 10 to about 20 and more preferably about 16, and R is a ($C_1$–$C_3$) alkylene group.

The concentration of the nonionic surfactant as based on the gasoline composition ranges from about 0.05 to about 1.8 weight percent, preferably from about 0.1 to about 1.6 weight percent. A low dosage, e.g., about 1.6 weight percent or less of the nonionic surfactant will solubilize the water and form a microemulsion. The microemulsion is of the "water-in-petroleum" type in which the average particle diameter of the dispersed phase is about 0.1 micron or smaller. By adding such nonionic adduct to a hazy, water-saturated gasoline blend, clear and stable gasoline-alcohol-water motor fuel compositions having upgraded performance characteristics are provided.

According to the present process, a hazy gasoline which can be converted to a clear, stable gasoline blend, comprises methanol in the amount of from about 2.0 to about 12.0, preferably from about 2.0 to about 5.0 volume percent, and more preferably from about 2.70 to about 4.75 volume percent, a cosolvent ($C_2$–$C_5$) aliphatic alcohol selected from the group consisting of ethanol in the amount of from about 2.0 to about 10.0 volume percent, preferably from about 4.75 to about 9.0 volume percent, isopropanol in the amount of from about 2.0 to about 10.0 volume percent, preferably, from about 4.75 to about 9.0 volume percent, secondary butyl alcohol in the amount of from about 2.0 to about 10.0 volume percent, preferably from about 4.75 to about 9.0 volume percent, tertiary butyl alcohol in the amount of from about 2.0 to about 10.0 volume percent, preferably from about 4.75 to about 9.0 volume percent, pentanol in the amount of about 2.0 to about 10.0 volume percent, preferably from about 4.75 to about 9.0 volume percent, and mixtures thereof in the amount of about 3.0 to 9.0 volume percent; and contaminating water in the amount of about 0.1 to about 0.5 weight percent.

The alcohols in the clear, stable gasoline blend contribute a total oxygen content to the fuel, ranging from about 1.0 to about 7.5 weight percent.

The clear, stable alcohol-gasoline motor fuel composition, on the basis of such fuel composition comprises from about 2.0 to about 12.0 volume percent of methanol, from about 2.0 to about 10 volume percent of an alcohol selected from the group consisting of ethanol, isopropanol, secondary butyl alcohol tertiary butyl alcohol, pentanol, and mixtures thereof; about 0.10 to about 0.5 weight percent water due to contamination; and about 0.05 to about 1.8 weight percent, such as about 0.1 to about 1.6 weight percent of a nonionic surfactant of an adduct of soya sterol and 5–30 moles of a polyalkylene oxide. Preferably, the volumetric ratio of tertiary butyl alcohol and/or isopropanol to methanol and/or ethanol in the clear stable motor fuel composition ranges from about 0.3 to about 3.0, and more preferably from about 0.5 to about 2.0.

The hazy gasoline is converted to a clear, stable gasoline by the addition to the hazy gasoline of a nonionic surfactant of an adduct of soya sterol and polyalkyleneneoxide in the amount of about 0.05 to about 1.8 weight percent, preferably from about 0.1 to about 1.6 weight percent, and blended with the hazy gasoline until a clear stable gasoline is obtained.

The nonionic surfactant which is used to convert the hazy gasoline to a clear stable motor fuel composition comprises an adduct of soya sterol and a polyalkylene oxide, and may be represented by the formula

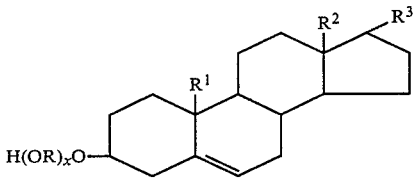

wherein R is a ($C_1$–$C_5$) alkylene group such as ethylene (—$CH_2CH_2$—) or isopropylene

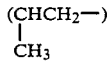

x is a numeral of about 5 to about 30, preferably about 10 to 20 and more preferably about 16; $R^1$ and $R^2$ are H or a ($C_1$–$C_2$) alkyl group; and $R^3$ is a polyalkylene group such as

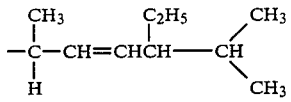

or an alkyl, alkaryl, aralkyl, aryl, or cycloalkyl hydrocarbon group.

The nonionic surfactant of an adduct of soya sterol and polyalkylene (i.e., a polyethoxylated or polyisopropoxylated soya sterol) may be commercially available under the trademark of GENEROL. The products sold under this trademark are manufactured by the Henkel Corporation of Teaneck, N.J.

Illustrative of these compositions may be those listed below in Table I, the first listed being the most preferred.

TABLE I

A. GENEROL 122 brand of polyethoxylated soya sterol wherein R (Formula I) is ethylene and x is 16.

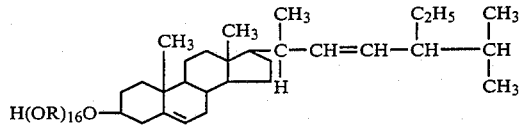

B.

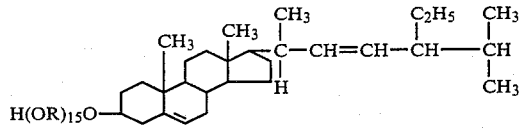

C.

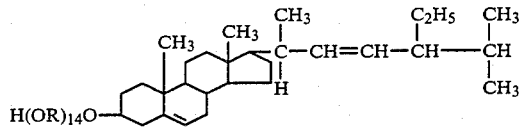

D.

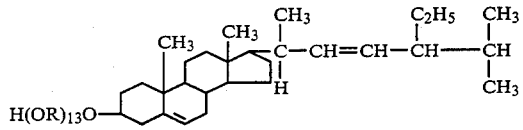

E.

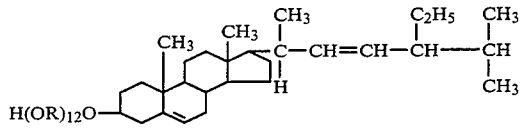

Also, according to the present invention, a clear, potentially hazy, water-saturated alcohol-gasoline blend may be rendered clear and stable by the present process where the alcohol-gasoline blend contains more than about 0.4 volume percent of contaminating water and the ambient temperature is less than about 35° F.

However, where the clear, potentially hazy, water-saturated gasoline blend contains less than about 0.4 volume percent of contaminating water and the ambient temperature is greater than about 35° F., an alternate process of the present invention is preferably used. In this process, the clear, potentially hazy, water-saturated gasoline blend is first diluted with unleaded gasoline in a volume ratio of unleaded gasoline to water-saturated gasoline in the ratio of about 10:90 to about 50:50, preferably about 30:70, and then, as described above, there is added a nonionic surfactant of an adduct of soya sterol and a polyalkylene oxide

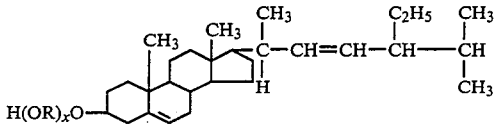

(I)

wherein x is a numeral of about 5 to about 30, and R is a ($C_1$–$C_3$) alkylene group.

Any gasoline suitable for a spark-ignited internal combustion engine can be extended and its octane rating increased by being blended with water and a specific alcohol or mixture of alcohols in accordance with the practice of this invention. Thus, clear stable alcohol-gasoline motor fuel compositions are produced. In general, the base fuel will consist of a mixture of hydrocarbons in the gasoline boiling range, i.e., boiling from about 75° to about 450° F. The hydrocarbon components may consist of paraffinic naphthenic, aromatic and olefinic hydrocarbons. This gasoline can be obtained naturally or it may be produced by thermal or catalytic cracking and/or reforming of petroleum hydrocarbons. The base fuel will generally have a Research Octane Number.

Any gasoline suitable for a spark-ignited internal combustion engine can be extended and its octane rating increased by being blended with water and a specific alcohol or mixture of alcohols in accordance with the practice of this invention. Thus, clear stable gasoline-alcohol-water motor fuel compositions are produced. In general, the base fuel will consist of a mixture of hydrocarbons in the gasoline boiling range, i.e., boiling from about 75° to 450° F. The hydrocarbon components may consist of paraffinic naphthenic, aromatic and olefinic hydrocarbons. This gasoline can be obtained naturally or it may be produced by thermal or catalytic cracking and/or reforming of petroleum hydrocarbons. The base fuel will generally have a Research Octane Number (RON) above 85 and up to about 102 with the preferred range being from about 90 to about 100.

In most cases, water from an external source is introduced into the motor fuel composition to supplement any water that may be dissolved in the alcohol and/or gasoline. Sources of water is from moist air or other contamination or bottom phase water, e.g., process water that sinks to the bottom of a gravity separation tank containing gasoline.

In another embodiment, gasoline contaminated with water may be processed into an upgraded clear stable motor fuel. In such case, the gasoline-water mixture is mixed with a mixture of the aforesaid alcohols, any additional water, and the nonionic surfactant of an adduct of soya sterol and polyethylene oxide of polyisopropylene oxide having the previously described Formula I. The amount of each constituent is the same as that previously described in the preferred embodiment. Agitation is continued until a clear dispersion is produced.

Advantages of the present invention are illustrated by the following examples. These examples are set forth for the purpose of illustration and should not be construed as limiting the invention.

EXAMPLE I

A clear stable gasoline-alcohol-water fuel Composition No. 1 was made by mixing together 50 parts by volume of clear unleaded gasoline (base fuel) and 50 parts by volume of clear gasoline with the addition of 4,000 parts per million of water to simulate water contamination, 2.7 volume percent of methanol, and 6.3 volume percent of tertiary butyl alcohol to produce a hazy fuel composition. A nonionic surfactant (Formula I) comprising an adduct of a soya sterol and a polyethylene oxide having 5 to 30 ethylene oxide groups was then added dropwise at room temperature (70°–75° F.) into the hazy fuel composition until the mixture was clear.

The amount of surfactant required to obtain a clear blend from a hazy blend of gasoline at different temperatures, are provided below in Table II.

TABLE II

| ML Of Generol 122E16[a] Required For Clear Blend | | | | |
|---|---|---|---|---|
| Gasoline (ml) | | ML Of Surfactant Added | | |
| Wet Gasoline With Oxinol 30[b] | Unleaded Gasoline | Room Temp. | 35° F. | 5° F. |
| 10 | 90 | 0.15 | 0.15 | 0.15 |
| 30 | 70 | 0.48 | 0.48 | 0.48 |
| 50 | 50 | 2.58 | 2.58 | 2.58 |

[a]Formula (II) nonionic surfactant (50% active)
[b]Oxinol 30 consists of 70 (v) % tertiary butyl alcohol and 30 (v) % methanol From Table II above, it is evident that at a temperature of 5° F., no additional surfactant is needed to provide a clear blend.

Additioonal examples of various formulations of the subject clear stable gasoline-alcohol-water motor fuel compositions are shown below in Table III.

TABLE III

CLEAR STABLE GASOLINE-ALCOHOL-WATER MOTOR FUELS

| | Example | | | | | |
|---|---|---|---|---|---|---|
| | 2 | | 3 | | 4 | |
| INGREDIENT | Broad* | Pref.** | Broad | Pref. | Broad | Pref. |
| Methanol, Vol. % | 2.0–12.0 | 2.7–4.75 | 2.0–12.0 | 2.7–4.75 | — | — |
| and/or Ethanol, Vol. % | 2.0–10.0 | 9.0–10.0 | 2.0–10.0 | 4.75–6.3 | 5.0–10.0 | 5.0–10.0 |
| Tertiary Butyl Alcohol, Vol. % | 2.0–10.0 | 4.75–6.3 | — | — | 4.0–7.0 | 9.0–10.0 |
| and/or Isopropanol, Vol. % | 2.0–10.0 | 4.75–6.3 | — | — | 4.0–7.0 | 9.0–10.0 |
| Water, Wt. % | 0.1–0.5 | 0.3–0.4 | 0.1–0.5 | 0.3–0.4 | 0.1–0.5 | 0.3–0.3 |
| Surfactant, Formula I Wt. % | 0.05–1.8 | 0.1–1.6 | 0.05–1.8 | 0.1–1.6 | 0.05–1.8 | 0.1–1.6 |

TABLE III-continued

| CLEAR STABLE GASOLINE-ALCOHOL-WATER MOTOR FUELS | | | | | | |
|---|---|---|---|---|---|---|
| Gasoline, Vol. % | Remainder | | Remainder | | Remainder | |
| | Example | | | | | |
| | 5 | | 6 | | 7 | |
| INGREDIENT | Broad | Pref. | Broad | Pref. | Broad | Pref. |
| Methanol, Vol. % and/or | — | — | 2.0–12.0 | 2.7–4.75 | — | — |
| Ethanol, Vol. % | 2.0–10.0 | 5.0–10.0 | — | — | — | — |
| Tertiary Butyl Alcohol, Vol. % and/or | — | — | 2.0–10.0 | 4.75–6.3 | 5.0–10 | 4.7–7.0 |
| Isopropanol, Vol. % | — | — | 2.0–10.0 | 4.0–6.0 | 5.0–10 | 4.7–7.0 |
| Water, Wt. % | 0.1–0.5 | 0.3–0.4 | 0.1–0.5 | 0.3–0.4 | 0.1–0.5 | 0.3–0.4 |
| Surfactant, Formula I Wt. % | 0.05–1.8 | 0.1–1.6 | 0.05–1.8 | 0.1–1.6 | 0.05–1.8 | 0.1–1.6 |
| Gasoline, Vol. % | Remainder | | Remainder | | Remainder | |

*Broad — Broad acceptable range of volume percents.
**Pref. — Preferred range of volume percents.

Although this invention has been illustrated by reference to specific embodiments, it will be apparent to those skilled in the art that various changes and modifications may be made which clearly fall within the scope of this invention.

We claim:

1. A process for making a clear, stable gasoline blend from a hazy, water-saturated gasoline containing a mixture of hydrocarbons in the gasoline boiling range, from about 2.0 to about 12.0 volume percent of methanol, from about 2.0 to about 10.0 volume percent of a cosolvent ($C_2$–$C_5$) aliphatic alcohol, and 0.1 to 0.5 volume percent of contaminating water, said process comprising adding to said water-saturated gasoline, from about 0.5 to about 1.8 weight percent of a nonanionic surfactant of an adduct of soya sterol and a polyalkylene oxide

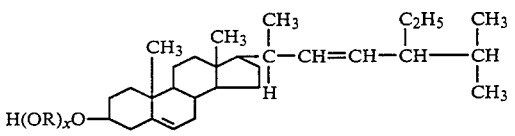

wherein x is a numeral of about 5 to about 30, and R is a ($C_1$–$C_3$) alkylene group.

2. The process of claim 1, wherein the ($C_2$–$C_5$) aliphatic alcohol is selected from the group consisting of from about 2.0 to about 10.0 volume percent of ethanol, from about 2.0 to about 10.0 volume percent of isopropanol, from about 2.0 to about 10.0 volume percent of secondary butyl alcohol, form about 2.0 to about 10.0 volume of tertiary butyl alcohol, from about 2.0 to about 10.0 volume percent of pentanol, and from about 3.0 to about 9.0 volume percent of a mixture thereof.

3. The process of claim 1, wherein the water-saturated gasoline contains from about 2.0 to about 5.0 volume percent of methanol, from about 2.0 to about 10.0 volume percent of ethanol, and from about 2.0 to about 10.0 volume percent of tertiary butyl alcohol and/or from about 2.0 to about 10.0 volume percent of isopropanol.

4. The process of claim 3, wherein the volume ratio of tertiary butyl alcohol and/or isopropanol to methanol and ethanol ranges from about 0.3 to about 3.0.

5. The process of claim 1, wherein the clear, stable gasoline blend has a total oxygen content ranging from about 1.0 to about 7.5 weight percent.

6. The process of claim 1, wherein the hazy, water-saturated gasoline is made clear and stable down to a temperature of about −10° F.

7. The process of claim 1, wherein there is more than about 0.4 volume percent of contaminating water and the ambient temperature is less than about 35° F.

8. The process of claim 1, wherein the nonionic surfactant is added in the concentration of about 0.1 to about 1.6 weight percent.

9. The process of claim 1, wherein the hazy gasoline is a microemulsion in which the average particle diameter of the dispersed phase is about 0.1 micron.

10. The process of claim 1, wherein the nonionic surfactant is

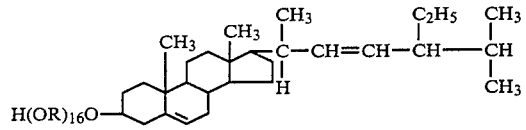

11. A process for making a clear, stable gasoline blend from a clear, potentially hazy water-saturated gasoline containing a mixture of hydrocarbons in the gasoline boiling range, from about 2.0 to about 12.0 volume percent of methanol, from about 2.0 to about 10.0 volume percent of a cosolvent ($C_2$–$C_5$) aliphatic alcohol, less than about 0.4 volume percent of contaminating water, and the ambient temperature is more than about 35° F., said process comprising:

(a) diluting the water-saturated gasoline with unleaded gasoline in a volume ratio of unleaded gasoline to water-saturated gasoline of from about 10:90 to about 50:50; and (b) adding to said diluted gasoline from about 0.05 to about 1.8 weight percent of a nonionic surfactant of an adduct of soya sterol and a polyalkylene oxide

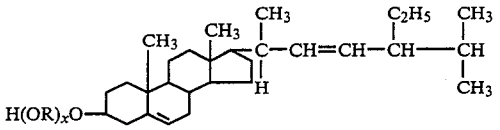

wherein group, x is a numeral of about 5 to about 30, and R is a ($C_1$–$C_3$) alkylene group.

12. The process of claim 11, wherein the ($C_2$–$C_5$) aliphatic alcohol is selected from the group consisting of from about 2.0 to about 10.0 volume percent of ethanol, from about 2.0 to about 10.0 volume percent of isopropanol, from about 2.0 to about 10.0 volume of secondary butyl alcohol, from about 2.0 to about 10.0 volume percent of tertiary butyl alcohol, from about 2.0 to about 10.0 volume percent of pentanol, and from about 3.0 to about 9.0 volume percent of a mixture thereof.

13. The process of claim 12, wherein the water-saturated gasoline contains from about 2.0 to about 5.0 volume percent of methanol, from about 2.0 to about 10.0 volume percent of ethanol and from about 2.0 to about 10.0 volume percent of tertiary butyl alcohol and/or from about 2.0 to about 10.0 volume percent of isopropanol.

14. The process of claim 13, wherein the volume ratio of tertiary butyl alcohol and/or isopropanol to methanol and ethanol ranges from about 0.3 to about 3.0.

15. The process of claim 11, wherein the clear, stable gasoline blend has a total oxygen content ranging from about 1.0 to about 7.5% weight percent.

16. The process of claim 11, wherein the water-saturated gasoline is made clear and stable down to a temperature of about −10° F.

17. The process of claim 11, wherein the volume ratio of unleaded gasoline to water-saturated gasoline is about 10:90.

18. The process of claim 11, wherein the volume ratio of unleaded gasoline to water-saturated gasoline is about 50:50.

19. The process of claim 11, wherein the volume ratio of unleaded gasoline to water-saturated gasoline is about 30:70.

20. The process of claim 11, wherein the nonionic surfactant is added in the concentration of about 0.1 to about 1.6 weight percent.

21. The process of claim 11, wherein the water-saturated gasoline is a microemulsion in which the average particle diameter of the dispersed phase is about 0.1 micron.

22. The process of claim 11, wherein the nonionic surfactant is

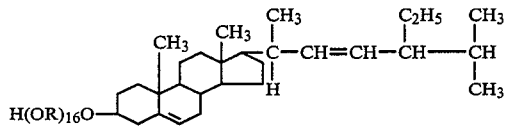

* * * * *